US006227401B1

(12) United States Patent
Rowland et al.

(10) Patent No.: US 6,227,401 B1
(45) Date of Patent: May 8, 2001

(54) RAG BUCKET

(75) Inventors: Dale Rowland, Franklin; Norman Manning, Hendersonville, both of TN (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/249,716

(22) Filed: Feb. 12, 1999

(51) Int. Cl.[7] ..... B65D 1/34

(52) U.S. Cl. ..... 220/571.1; 220/572; 220/801; 220/372; 206/508

(58) Field of Search ..... 220/571, 571.1, 220/572, 573, 501, 521, 801, 802, 369, 370, 371, 372; 206/508

(56) References Cited

U.S. PATENT DOCUMENTS

| | | | | |
|---|---|---|---|---|
| D. 362,804 | | 10/1995 | Warren . | |
| 381,253 | * | 4/1888 | Kinports | 220/571 |
| 1,068,900 | | 7/1913 | Herd . | |
| 1,278,695 | | 9/1918 | Ludwig . | |
| 2,667,976 | | 2/1954 | Weidner . | |
| 3,301,464 | | 1/1967 | Amberg . | |
| 3,516,571 | * | 6/1970 | Roper et al. | 206/508 X |
| 3,677,430 | * | 7/1972 | Yates, Jr. | 206/508 X |
| 4,079,857 | * | 3/1978 | Crisci | 220/306 |
| 4,293,073 | * | 10/1981 | Yates, Jr. | 206/519 |
| 4,296,871 | * | 10/1981 | Andersson | 220/306 |
| 4,804,470 | | 2/1989 | Calvillo et al. . | |
| 5,031,796 | | 7/1991 | Schäfer et al. . | |
| 5,059,319 | | 10/1991 | Welsh . | |
| 5,083,674 | * | 1/1992 | Clark | 206/508 X |
| 5,143,219 | * | 9/1992 | Yates, Jr. | 206/508 |
| 5,172,739 | * | 12/1992 | Ristroph | 220/573 X |
| 5,186,828 | | 2/1993 | Mankin . | |
| 5,350,065 | | 9/1994 | Darrey . | |
| 5,351,931 | * | 10/1994 | Houben et al. | 220/571 X |
| 5,388,715 | | 2/1995 | Schwindt . | |
| 5,540,349 | * | 7/1996 | Philips | 220/306 |
| 5,575,848 | * | 11/1996 | Chedville | 220/501 X |
| 5,611,377 | * | 3/1997 | Maguire | 220/572 X |
| 5,653,271 | * | 8/1997 | Brittain et al. | 220/571.1 X |
| 5,975,344 | * | 11/1999 | Stevens | 220/790 |

* cited by examiner

*Primary Examiner*—Stephen K. Cronin
(74) *Attorney, Agent, or Firm*—Wood, Herron & Evans, LLP

(57) ABSTRACT

A rag bucket having a lid received against a tub's rim that allows bleached rags with residual odors of bleach contained therein to breathe with the outside air. The rag bucket lid has an aperture covered by a screen which allows the rags, when sealed therein, to breathe. The lid is recessed into the tub so that after the bleached rags have been removed, the lid may act as a strainer, for example, for paint to allow "good" paint to pass through the screen into the tub, and "bad" paint or impurities to be trapped on top of the screen to be discarded so as not to spoil a painter's work.

5 Claims, 2 Drawing Sheets

RAG BUCKET

FIELD OF THE INVENTION

This invention relates to buckets. More specifically, this invention is directed towards a rag bucket with a screen lid.

BACKGROUND OF THE INVENTION

As is common and unavoidable in the painting industry, painters' equipment and work product is often splattered with paint in the course of a job. Over time and numerous painting jobs, splattered paint left to dry on equipment or projects becomes extremely difficult to remove. In order to combat this war against splattered paint, professional painters are constantly cleaning their equipment and work with inexpensive and commercially available rags.

The rag industry is typically supplied with the raw material for the rag product from clothing companies' surplus or discard stock of cotton cloth. As is very often the case, rag raw material from the clothing companies is dyed various colors and undesirable to professional painters in this state. Professional painter generally prefer rags with bleached white or a uniform neutral color in order to discern that when equipment or paint projects need to be wiped clean of fresh paint, the rag that they are grabbing is, indeed, clean and will not bleed color onto the object they are attempting to clean.

In order to provide professional painters with a rag having white or a uniform neutral color, the rag industry bleaches their raw product with extremely strong and nocuous smelling bleach. Even after the rag raw material has been bleached and processed into generally uniformly sized rags to be packaged and sold, a residual nocuous odor from the bleach remains embedded therein. The rag industry has generally simply bagged the processed rags in plastic bagging which, when ripped open by a painter, releases bleach fumes to be inhaled by the painter. Therefore, it would be desirable to provide bleached rags so that a purchaser would not be overwhelmed by bleach fumes upon opening a plastic bag containing rags.

Another problem faced by professional painters these days is that, while paint is generally less expensive to purchase, it is also of lesser quality. This inexpensive paint often has impurities, e.g., coagulated paint, that must be removed by a painter before the paint may be used. If the impurities are not removed, a painter may have to apply multiple coats of paint, thereby increasing the job costs, or possibly even lose painting jobs because of customer word-of-mouth relating unsatisfactory work.

OBJECTIVES OF THE INVENTION

It has therefore been an object of the present invention to provide a rag container for professional painters which is usable by a painter and still allows bleached rags to continue to release the residual bleach odor after they have been packaged.

It has been a further object of the present invention to provide a rag container in the form of a paint bucket and strainer lid which may be used to separate paint from impurities contained therein after the rags sold in the bucket have been removed from the bucket.

Still another objective of this invention has been to provide a paint bucket and strainer lid combination useful as a shipping container for bleached painter's rags and which may be stacked for storage or shipment.

SUMMARY OF THE INVENTION

The objects of the present invention are achieved by providing a rag bucket that has a lid adapted to allow bleached rags captured in a bucket or tub to "breathe" with the outside environment. The lid has an aperture covered by a captured screen. The bleached rags are packaged in the rag bucket so that residual bleach fumes may pass through the screen when the lid is sealed to the rag bucket.

Air outside the rag bucket is allowed to pass through the screen and, thus, allows rags contained therein to "breathe".

After the rags have been removed from the bucket, the lid may be replaced and the rag bucket may be used to strain impurities from paint. The screen is recessed from the lip of the lid down into the tub, providing a dam to keep paint from easily overflowing the lip of the lid. "Good" paint passes through the screen and into the tub, and paint impurities are trapped on the screen to thereafter be discarded. The screen is also recessed inwardly from the side walls of the lid such that buckets having lids located therein may be stacked one atop the other without placing any weight upon the relatively weak screen.

DETAILED DESCRIPTION OF THE PREFERRED EMBODIMENT

Figure 1:
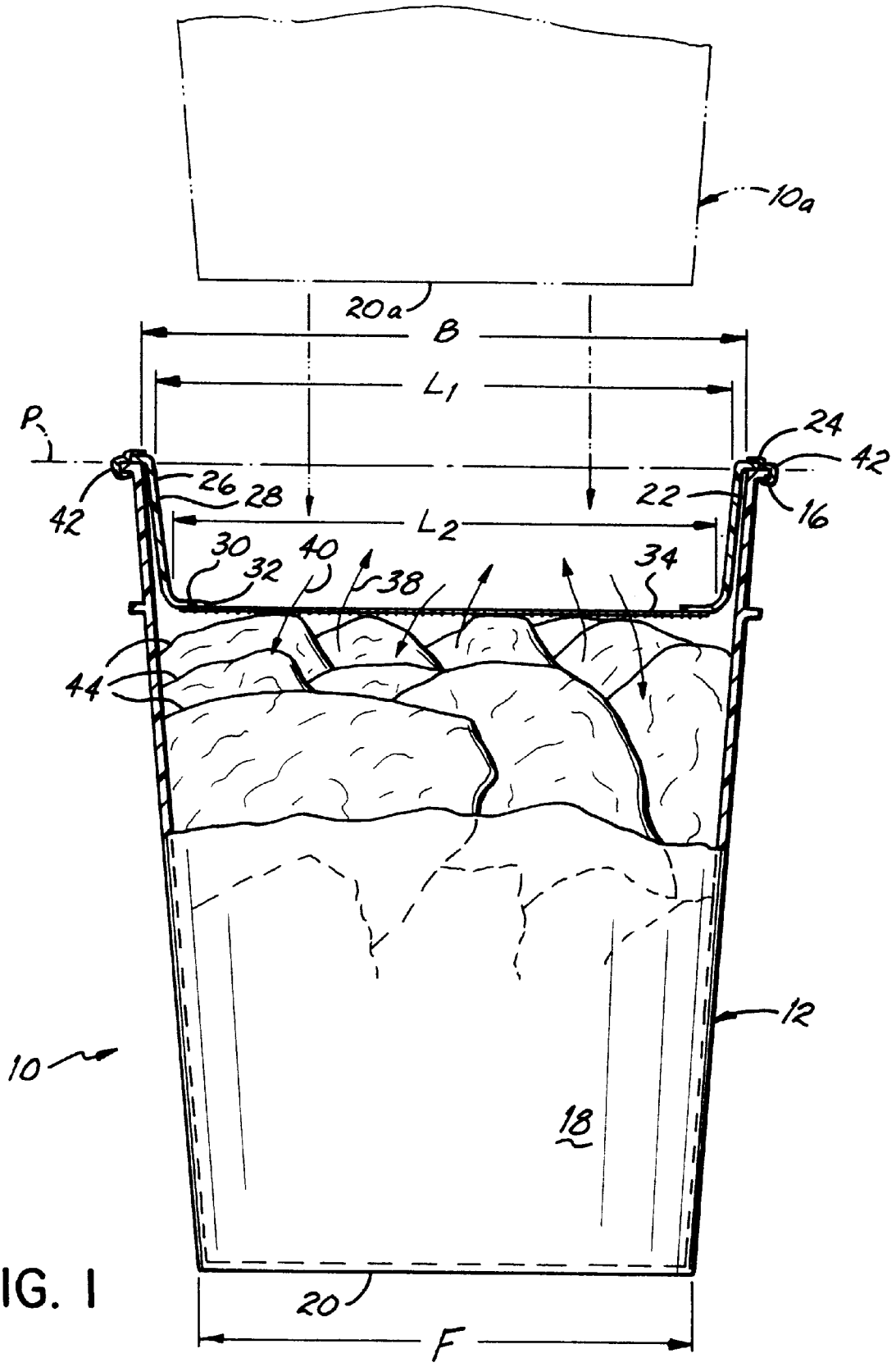
FIG. 1 is a partially cutaway side view of the rag bucket of the present invention.
Figure 2:
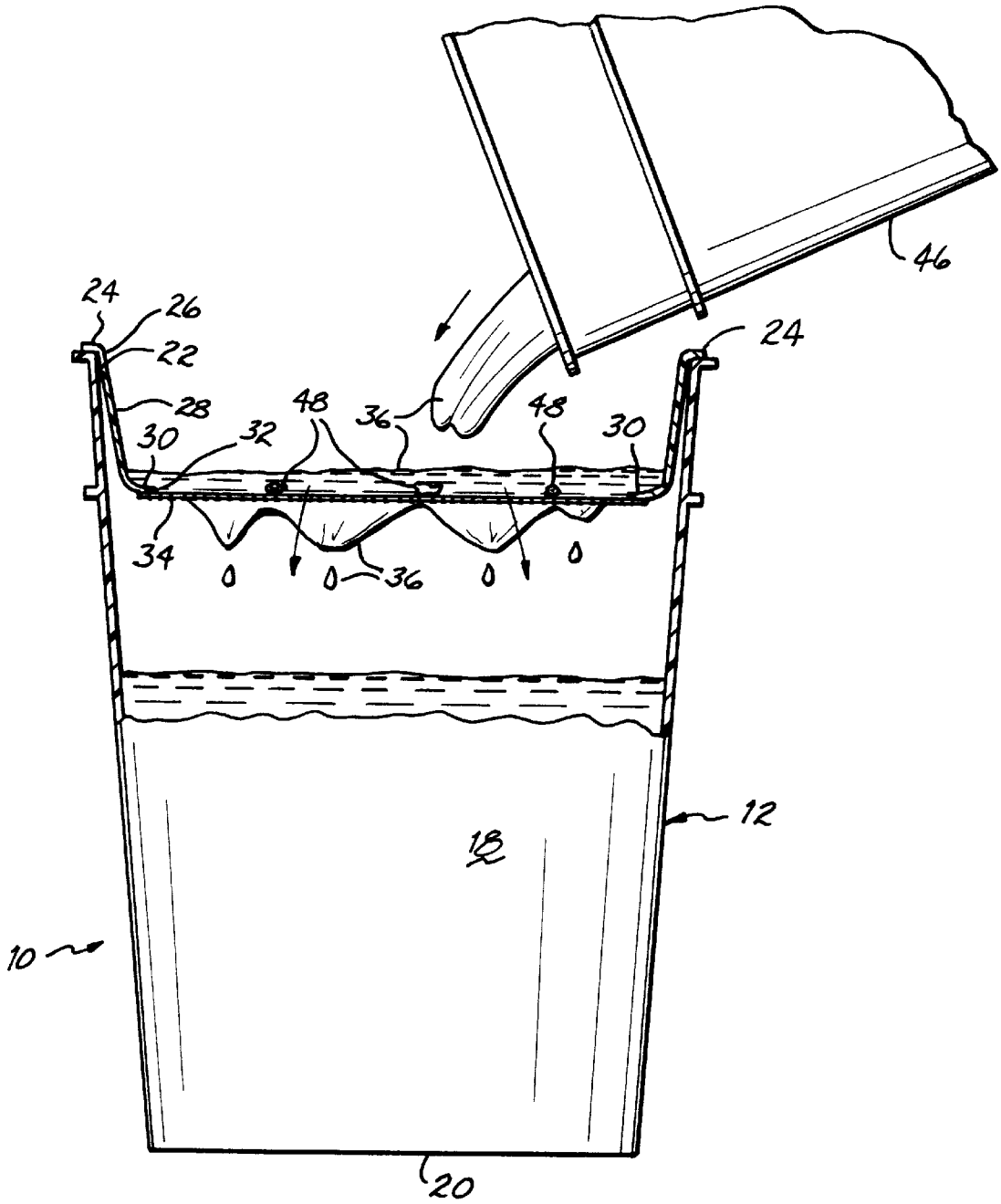
FIG. 2 is a partially cutaway side view of the rag bucket of the present invention used to strain paint.

As can be seen generally in FIGS. 1 and 2, the preferred embodiment of the present inventive rag bucket 10 has an open top tub or bucket 12 and a lid 14.

In the preferred embodiment, the tub 12 is a five gallon painter's bucket commonly known in the art. The tub 12 has a rim 16 integrally attached to a wall 18 that is integrally attached to a floor 20. The tub rim 16 defines an aperture 22 having an inside diameter B larger than the tub floor's outside diameter F. In the preferred embodiment, B is about 11.5 inches (29.2 cm) and F is about 10.25 inches (26.0 cm). The wall 18 has a substantially uniform thickness throughout the tub's vertical extent and is gradually tapered from its attachment with the rim 16 to its attachment with the floor 20.

In the preferred embodiment, the lid 14 has a lip 24 that is received against the upper surface of the rim 16. The lip 24 defines a first lid hole 26 having a diameter $L_1$ greater than that of the tub floor diameter F. In the preferred embodiment, $L_1$ is about 11.25 inches (28.6 cm). The lid 14 has a dam 28 integrally attached to the lip 24 which, when the lip 24 is engaged against the tub rim 16, extends below the tub rim horizontal plane P. The lid 14 has a ledge 30 integrally attached to the dam 28 that has a diameter $L_2$ greater than the tub floor diameter B. In the preferred embodiment, $L_2$ is about 11.0 inches (27.9 cm). In the preferred embodiment, the ledge 30 has a width of about 1.0 inch (2.54 cm) extending inwardly from the dam 28 and defining a second lid hole 32.

The lid 14 has a screen 34 attached to the margin of the ledge 30 that allows selective transmission of media, e.g., paint 36, bleach fumes 38, and air 40, between the inside and outside of the rag bucket 10. In the preferred embodiment, the screen 34 has a mesh sized to the size of the impurities to be filtered from the paint. The screen 34 is adhesively attached to the ledge 30, but it will be understood that the screen 34 may be attached to the ledge 30 by any suitable means known in the art. In the preferred embodiment, the lid 14 and tub 12 are held together with a seal, e.g., a plastic tape 42, to package and contain bleached rags 44 therein, however, it will be understood that the lid 14 may be sealed to the tub 12 by any acceptable means known in the art.

In the preferred embodiment, the tub 12 having the lid 14 sealed thereto contains the rags 44 which have previously been subjected to a bleaching process known in the art to provide the rags 44 with a generally uniform color. Because the bleaching process leaves a very strong residual odor of bleach on the rags 44, when packaged in the rag bucket 10, the fumes 38 from the bleaching process are allowed to escape through the screen 34 and the outside air 40 is allowed to enter into the rag bucket 10 and circulate with the rags 44 so that they may "breathe" with the exterior environment.

In the preferred embodiment, a first rag bucket 10 may receive a second rag bucket 10*a* (shown in phantom lines in FIG. 1), upon the first bucket's lid 14 so that the second rag bucket floor 20*a* rests upon the ledge 30. In the preferred embodiment, the ledge 30 is wide enough so that the second rag bucket 10*a* stacked upon the ledge 30 will not come into contact with the screen 34, thereby preserving the screen 34 from tearing or deformation.

In the preferred embodiment, after the tape 42 sealing the lid 14 and the tub 12 has been broken and the rags have been removed, the lid 14 may be replaced on the tub 12 so that the rag bucket 10 may be reused to strain, for example, paint 36. Paint 36 is poured from a paint can 46 onto the screen 34. Since the screen 34 is recessed into the tub 12 from the horizontal plane of the rim P, the lid 14 can be filled with relatively large volumes of paint 36 without overflowing the lip 24. In the preferred embodiment, the screen 34 is offset from the lip 24 by about 3.5 inches (8.9 cm). Thus used, the lid 14 allows "good" paint 36, i.e., paint free of impurities 48, to pass through the screen 34, while the impurities 48, e.g., solid objects or coagulated paint or the like, is trapped on top of the screen so that the impurities 48 may be discarded so as not to spoil a painter's job.

From the above disclosure of the detailed description of the preferred embodiment and the preceding summary of the preferred embodiment, those skilled in the art will comprehend the various modifications to which the present invention is susceptible. Therefore, I desire to be limited only by the scope of the following claims and equivalents thereof.

What is claimed is:

1. A stackable bucket for holding rags, comprising:

a tub having a wall, a floor having a first floor diameter integrally attached to said wall and a rim extending radially outwardly from an upper edge of said wall;

a lid adapted to be placed against said tub rim, wherein said lid has a lip directly receivable against said upper surface of said rim, a dam having a substantially uniform thickness and being integrally attached to said lip, said dam extending substantially below said rim towards said floor when said lid is placed against said rim, and a horizontally oriented ledge extending radially inwardly from said dam and defining a hole, wherein said ledge has a diameter greater than said first floor diameter and said hole has a diameter smaller than said first floor diameter; and a screen attached to said ledge to selectively allow media to pass through said hole, wherein a second stackable bucket with a second floor having a diameter substantially equal to said first floor diameter may rest against said ledge without contacting said screen.

2. The bucket of claim 1, comprising:

a seal to hold said lid against said tub; and a plurality of rags captured within said tub by said lid.

3. A bucket for holding rags, comprising:

a tub having a horizontally oriented rim with an upper surface, a wall extending downwardly and inwardly from said rim, and a floor attached to said wall;

a lid adapted to be placed against said tub rim, wherein said lid has a lip adapted to contact said upper surface of said rim, a dam integrally attached to said lip extending substantially below said rim towards said floor when said lid is placed against said tub, said dam having a substantially uniform thickness and a ledge integrally attached to said dam and extending radially inwardly from said dam and defining a hole;

a screen attached to said ledge to selectively allow media to pass through said hole wherein the diameter of said screen is less than the diameter of said tub floor;

a seal holding said lid against said tub; and a plurality of rags held within said tub by said ledge and said screen.

4. A paint bucket for holding paint rags, comprising:

a tub having a horizontally oriented rim with an upper surface, a wall attached to said rim, and a floor attached to said wall, wherein said rim defines a rim hole having a first diameter and said floor has a second diameter less than said first diameter;

a lid adapted to be placed against said tub rim, wherein said lid has a lip adapted to contact said upper surface of said rim, said lip defining a first hole having a third diameter, said lid having a dam integrally attached to said lip, said dam having a substantially uniform thickness and extending substantially below said rim towards said floor when said lid is placed against said tub and an inwardly extended ledge integrally attached to said dam and defining a second hole;

a screen attached to said ledge to selectively allow liquid media to pass through said second hole, said screen having a mesh sized to remove impurities from said liquid media;

a seal holding said lid against said tub; and a plurality of bleached rags contained within said tub by said ledge and said screen.

5. A stackable paint bucket for holding paint rags, comprising:

a tub having a rim with an upper surface, a wall integrally attached to said rim, and a floor having a first floor diameter integrally attached to said wall;

a lid adapted to be loosely placed against said tub rim, wherein said lid has a lip directly receivable against said upper surface of said rim, a dam integrally attached to said lip, said dam having a substantially uniform thickness and extending substantially below said rim towards said floor when said lid is placed against said tub, and a ledge integrally attached to said dam defining a hole, wherein said ledge has a diameter greater than said first floor diameter and said hole has a diameter smaller than said first floor diameter;

a screen attached to said ledge and between said ledge and said floor when said lid is placed against said tub rim for selectively allowing media to pass through said hole, wherein a second stackable bucket with a second floor having a diameter substantially equal to said first floor diameter may rest against said ledge without contacting said screen;

a plurality of rags held within said tub by said lid, said screen enabling gaseous fumes from said rags to escape from said bucket; and a seal to tightly hold said lid against said tub to capture said rags within said bucket.

* * * * *